United States Patent [19]

Crane et al.

[11] 4,421,094

[45] Dec. 20, 1983

[54] PARABOLIC SHAPED HEATER

[76] Inventors: Roscoe K. Crane, Rte 12, Box 764-A, Fayetteville, N.C. 28306; Alton B. King, 3547 Antilles Cir., Hope Mills, N.C. 28348

[21] Appl. No.: 139,571

[22] Filed: Apr. 11, 1980

[51] Int. Cl.[3] ..... F24C 1/14

[52] U.S. Cl. ..... 126/61; 126/299 R; 126/99 P; 126/104 R

[58] Field of Search ..... 126/62, 58, 77, 83, 126/299 D, 61, 66, 67, 77, 121, 122, 123, 102, 99 P, 136, 299 R, 302, 104 R, 114

[56] References Cited

U.S. PATENT DOCUMENTS

| | | | |
|---|---|---|---|
| 90,537 | 5/1869 | Helm | 126/62 |
| 168,922 | 10/1875 | Marty et al. | 126/62 |
| 927,151 | 7/1909 | Keltonik | 126/67 |
| 1,116,674 | 11/1914 | Clarke | 126/61 |
| 3,596,587 | 8/1971 | Klinger | 126/299 D |
| 3,731,462 | 5/1973 | Costarella et al. | 126/299 D |
| 4,201,185 | 3/1980 | Black | 126/67 |

FOREIGN PATENT DOCUMENTS

| | | | |
|---|---|---|---|
| 1071485 | 12/1980 | Canada | 126/61 |

*Primary Examiner*—Samuel Scott
*Assistant Examiner*—G. Anderson
*Attorney, Agent, or Firm*—Mills and Coats

[57] ABSTRACT

The present invention relates to a parabolic shaped heater comprising a parabolically shaped lower wall structure enclosed by a horizontal heat collector panel, and wherein this enclosure defines a generally closed firebox for supporting fuel in the form of wood, coal and the like. Further, there is provided a hood that is suspended about an upper portion of the firebox and extends generally downwardly therearound, and is spaced outwardly therefrom such that air may be induced upwardly between the parabolic firebox and the hood, and over the heat collector panel so as to effectuate an efficient heat transferred between the firebox and the passing air. Finally, a central heat distributing system may be operatively associated with said hood for directing air therefrom to other parts of the structure housing said parabolic heater.

7 Claims, 4 Drawing Figures

PARABOLIC SHAPED HEATER

FIELD OF INVENTION

The present invention relates to stoves and heaters, and more particularly to a combustion type heater having a generally closed firebox for burning fuel such as wood, coal, oil, gas or the like. More particularly to present heater is designed to efficiently capture and utilize radiant energy generated within a parabolically shaped firebox.

BACKGROUND OF THE INVENTION

In recent years, stoves and heaters of the type particularly adapted to burn wood and coal, have begun to enjoy much commercial success. One of the principal reasons underlying this success is due to ever increasing prices of petroleum products and electricity. In this regard, it is appreciated that stoves of both the free-standing and even stoves referred to as fireplace stoves are being purchased by individuals as a means of more efficiently heating their dwellings.

With all the activity in wood stoves, there has been a substantial effort to provide a very efficient design. Some stoves today are generally more efficient than stoves in the past. But there is still many shortcomings and disadvantages in stoves commercially available today.

Among the shortcomings and disadvantages of present day stoves is the generally low overall efficiency found in such. While, as pointed out above, there have been improvements in some stove designs, many are designed to burn wood, and are not easily adapted to burn coal, oil, gas or the like.

One important shortcoming of conventional stoves and heaters of the type being referred to herein is that they often are only able to heat a relatively small area and are not designed in such a manner that the resulting heat can be easily and efficiently evenly distributed throughout a structure or dwelling.

SUMMARY OF INVENTION

The present invention entails a parabolic heater or stove that is designed to overcome many of the shortcomings and disadvantages of stoves and heaters of the prior art. Particularly, the parabolic heater of the present invention is designed to efficiently utilize the resulting heat from the fuel source burned therein. In addition, the parabolic heater of the present invention is designed to utilize numerous types of fuels, including wood, coal, oil and gas and is provided with a central heat distributing system that is functional to capture heat generated by the stove and to distribute the same generally evenly about a structure or dwelling.

More particularly, the stove of the present invention entails a parabolically shaped firebox including a lower parabolically shaped wall structure that is closed by a horizontal collector panel extending thereover. Fuel is generally burned in the area of the foci of the parabolically shaped lower wall structure such that resulting radiant energy is evenly directed against the parabolic wall structure of the heater and is reflected upwardly where the energy is collected about said horizontal heat collector panel.

Added to this is a suspended hood design that is effective to channel and direct air around the parabolic firebox and particularly toward the horizontal heat collector panel, wherein in the process the air collects the heat and transfers it to surrounding areas.

As a further part of the present invention, there is provided in conjunction with the parabolic heater, a central heat distributing system that is provided with auxiliary fan means for inducing air upwardly around said parabolic heater, interiorly of said hood means, and into a central duct system where the heat is transferred throughout an associated structure as desired.

It is, therefore, an object of the present invention to provide an efficient heater or stove for burning fuel such as wood, coal, oil, gas or the like.

Still a further object of the present invention is to provide a heater that will efficiently utilize produced radiant heat by focusing the radiant heat in the form of waves on the interior side wall structure of a parabolically shaped lower portion of the heater, and reflecting the radiant energy to a collector panel for collecting the radiant energy.

Another object of the present invention resides in the provision of a parabolic type heater of the character referred to above which is provided with a central heat distributing system that is effective to collect heat produced by said heater and to generally evenly distribute the same about an associated structure.

Yet another object of the present invention resides in the provision of a parabolic heater stove of the character described above provided with hood means that is operative to channel air in and around said parabolic heater in such a manner as to give rise to an efficient transfer of heat from said heater to air passing therearound.

More particularly, it is an object of the present invention to provide a heater with a lower parabolically shaped firebox wherein fuel is adapted to be burned about the foci of the parabolic firebox such that produced radiant energy is directed towards surrounding areas of said firebox and is reflected therefrom upwardly towards a collector panel that serves to collect the produced radiant energy.

Another object of the present invention resides in the provision of a stove or heater of the character referred to above provided with means for directing air into the firebox from outside for providing combustion air.

Other objects and advantages of the present invention will become apparent from a study of the following description and the accompanying drawings which are merely illustrative of the present invention.

THE PARABOLIC HEATER

Figure 1:
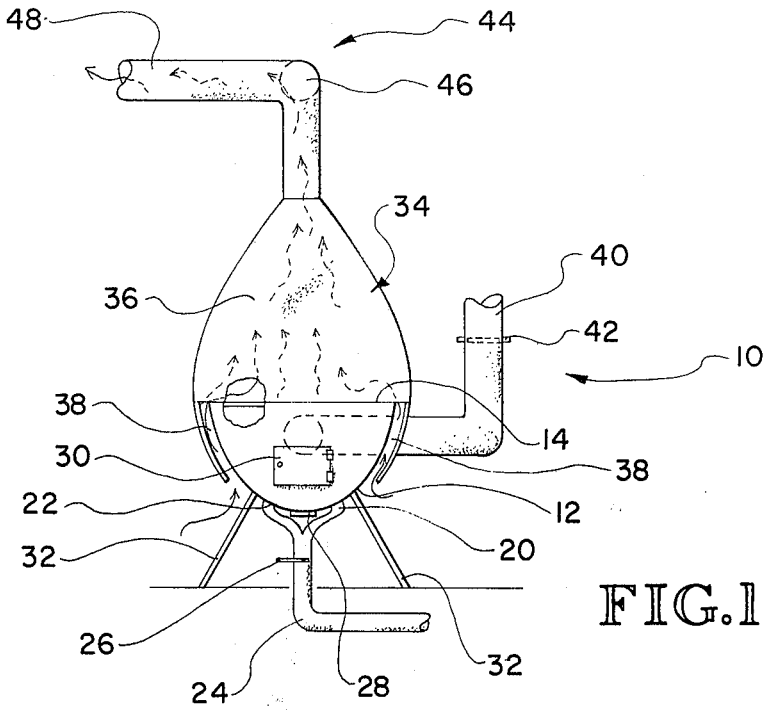
FIG. 1 is a front elevational view of the parabolic heater of the present invention.
Figure 2:
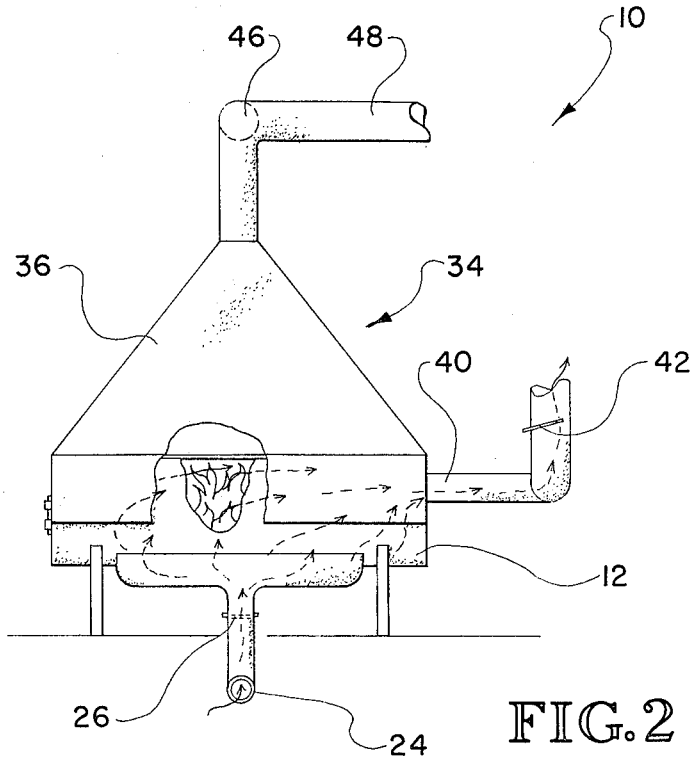
FIG. 2 is a side elevational view of the parabolic heater of the present invention particularly illustrating an elongated design.
Figure 3:
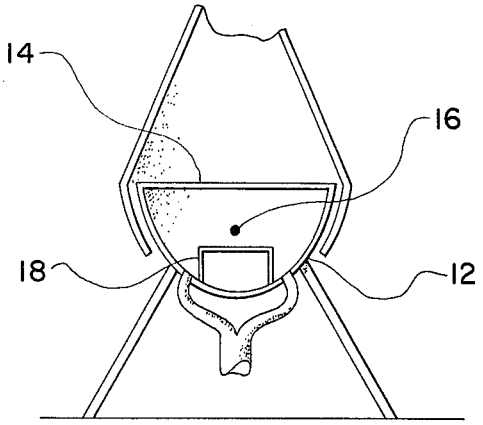
FIG. 3 is a fragmentary sectional view of the parabolic heater illustrating the foci thereof.
Figure 4:
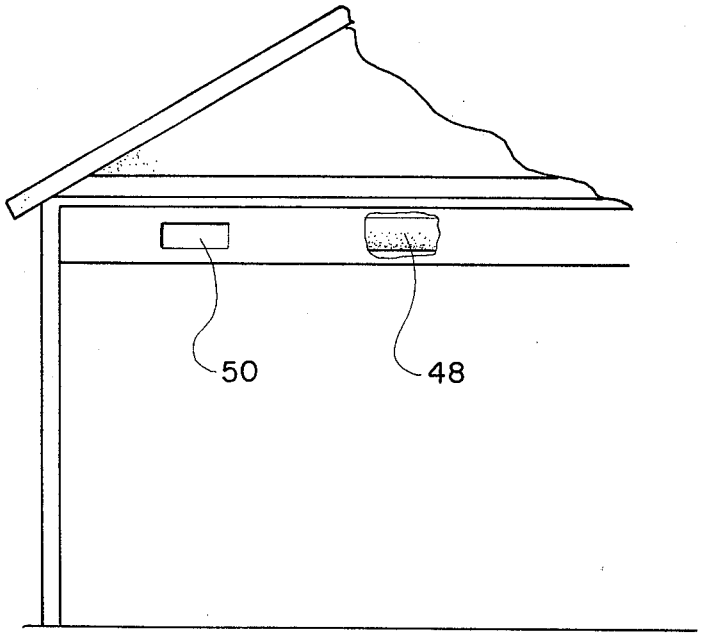
FIG. 4 is a schematic view illustrating how the heater of the present invention could be utilized as a central heating device.

With further reference to the drawings, the parabolic heater of the present invention is shown therein and indicated generally by the numeral 10. Viewing parabolic heater in detail, the same comprises a firebox that is formed by a generally parabolically shaped lower wall structure 12 having a top horizontal collector panel 14 disposed thereover. The parabolically shaped lower wall structure 12 and the collector panel 14 serve to form an enclosure and because of the parabolic shape, it is seen that spaced above the bottom of the wall structure 12 generally centrally located between the wall structure is an area referred to as the foci area 16.

Provided interiorly of the firebox is a fuel stand 18 that is adapted to receive and support solid types of fuel such as wood and/or coal for combustion. It should be appreciated that fuel stand 18 is particularly provided within the formed firebox in a location such that fuel supported thereby will burn about foci area 16 of the parabolically shaped firebox. Subsequently herein the significance of this feature will be discussed further.

To provide combustion air, the lower parabolically shaped wall structure is provided with air inlet ports 20 and 22 about the lower portions thereof for receiving combustion air from outside the structure housing the parabolic heater 10 of the present invention. In the case of the embodiment illustrated herein, the air inlet ports 20 and 22 would be communicatively connected to air supply 24 that would preferably be provided with some type of control means that could be responsive to temperature for controlling the flow of air to the interior of the formed firebox. In the embodiment illustrated, supply pipe 24 is provided with a damper 26 that could be operatively associated with other control means such as a temperature control, for continuously supplying air to the firebox.

Also provided with parabolic heater 10 is an ash dump 28 that allows the ashes to be conveniently and easily removed from the firebox. In addition, a fuel access door 30 is provided that allows fuel such as wood, coal, etc., to be supplied to the parabolic heater.

Associated with the lower parabolically shaped firebox is a heater stand 32 that supports the lower wall structure 12 in spaced apart relationship to an underlying support structure.

Suspended or supported about the parabolic firebox is hood means indicated generally by the numeral 34. Hood means 34 includes a hood structure 36 having a surrounding wall structure that is adapted to be disposed over the parabolic firebox. As seen in the drawings, the lower portion of the hood wall structure 36 extends below the surface of collector panel 14 and generally encompasses the surrounding wall structure 12. Yet additionally, there is a space 38 provided between the parabolically shaped lower wall structure 12 and the surrounding wall structures 36 such that air may be induced therebetween.

Referring back to the firebox, the same is provided with a communicatively connected flue pipe 40 that extends therefrom and is directed out of the structure for exhausting smoke and other combustion gases. Operatively connected within flue 40 is a damper 42.

In the embodiment illustrated herein, parabolic heater 10 is provided with a central heating control system indicated generally by the numeral 44. This central heating control system 44 includes fan means 46 operatively associated with said hood structure 36 for directly inducing air up and around the parabolic firebox and between the parabolically shaped lower wall structure 12 and the surrounding hood structure 38.

Communicatively connected to said hood means 34 is central conduit means 48 that extends from the parabolic heater 10 to certain desired areas of the associated structure. Central duct means 48 may extend along the upper ceiling edge of respective rooms of a structure and may even be housed along upper room corners between the walls and ceiling, as illustrated in the drawings. In this regard, at selected locations, it is contemplated that said central duct means 48 may be provided with heating outlets 50 for dispersing air into an adjoining area or room.

It is thusly appreciated that the operation of auxiliary fan means 46 would be operative to induce air upwardly through space 38 between the hood means 34 and the firebox and on upwardly over the collector panel 12, where heat from said firebox would be transferred thereto, and upwardly through said hood means into said central duct means 48 where the heated air is transferred and distributed through the associated structure.

One important feature of the present invention resides in the particular parabolic shape of the firebox and particularly the lower wall structure 12 thereof. In this regard, because fuel is being burned at the foci area 16, the produced radiant energy is directed in a symmetrical fashion about the areas of the parabolically shaped firebox. This radiant energy is reflected by the lower wall structure 12 back upwardly towards the collector panel 14 where the heat is collected thereabout. Because of this design, a substantial portion of radiant energy in the form of heat is collected and can be conveniently transferred to a passing system of air.

In some situations, it may be desirable to structure the firebox such that it assumes an elongated appearance. In such case, the lower parabolically shaped wall structure 12 would include opposite ends and with the provision of the horizontal collector panel 14, the entire firebox of the parabolic heater 12 could be closed. In such an elongated design, it is appreciated that the fuel stand 18 and the supply pipe 24 for the combustion air would be accordingly modified such that air would be directed into the lower portion of the firebox at longitudinal intervals.

It should be appreciated that the parabolic heater 10 and associated heat distribution system may be utilized in conjunction with a solar type heating system. In this regard, for example, the house or structure having the parabolic heater 10 associated therewith could be provided with an adjacent solar heating system that would be adapted to collect and even store energy.

For example, a solar heating system could be provided that would be adapted to be positioned juxtaposed to the house or dwelling and provided with an enclosure having a southern oriented transparent wall structure for receiving solar radiation therethrough. To store or retain the collected solar energy, the structure could be provided with heat retention means such as rock that would be thermally colored dark or black for receiving and storing the energy.

To effectively utilize such a solar heating system, the central heating system associated with the parabolic heater 10 of the present invention could be communicatively connected therewith in a proper manner so as to extract energy from the solar heating system or to even direct excess energy thereto for storage.

From the foregoing, it is appreciated that the parabolic heater of the present invention is specifically designed to increase heating efficiently of stoves adapted to burn wood, coal, oil, or gas. In this regard, the presence of the resulting radiant energy on the parabolically shaped interior wall of the lower wall structure 12 and reflecting the same radiant energy back upwardly to where it is collected on the collector panel 14 is a very important functional feature of the present invention.

The overall design produces a substantial transfer heat from the parabolic heater 10 to the air being induced upwardly adjacent thereto by said auxiliary fan means 46. Further, it is appreciated that the parabolic heater of the present invention is simple, relatively inexpensive, easy to use, durable, and particularly adapted to be utilized in conjunction with a central heating feature that allows the collected energy from heater or stove 10 to be distributed throughout a structure.

The terms "upper," "lower," "forward," "rearward," etc., have been used herein merely for th convenience of the foregoing specification and in the appended claims to describe the parabolic heater and its parts as oriented in the drawings. It is to be understood, however, that these terms are in no way limiting to the invention since the parabolic heater may obviously be disposed in many different positions when in actual use.

The present invention, of course, may be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A heater comprising: a generally closed arcuately shaped lower wall structure having a bottom area and generally upwardly projecting sides; support means associated with said lower wall structure for supporting the same; a burning area defined interiorly within said lower wall structure in such a manner that radiant heat resulting from material burned therein is reflected upwardly by the interior of said arcuately shaped lower wall structure; a generally horizontal heat collector panel exending across the upwardly projecting sides of said lower wall structure for collecting radiant heat reflected by the interior of said arcuately shaped lower wall structure; flue means communicatively connected with the burning area defined between said lower wall structure and said collector panel for enabling smoke and other exhaust gases resulting from material burned therein to be expelled from said heater; hood means extending downwardly around a portion of said lower generally closed arcuately shaped wall structure and projecting upwardly pass said collector panel, said hood means being spaced outwardly from said lower wall structure so as to define an air induction space between said hood means and the generally closed arcuately shaped lower wall structure for enabling air to move upwardly into and through said air induction space between said hood means and said lower wall structure and about said collector panel where heat is transferred to the passing air from said heater, said generally arcuately shaped lower wall structure being provided in the form of a parabola having a foci area within said burning area, and wherein said burning area is provided with burning material support means for supporting material being burned in the foci area such that combustion generally occurs about the foci area of said parabola and thus the resulting radiant energy is directed outwardly against the interior walls of said parabola type lower wall structure where the radiant energy is reflected back upwardly to said horizontal collector panel; and wherein said hood means assumes a suspended position over said lower parabolic shaped wall structure and extends downwardly pass said collector panel where a lower portion of said hood means generally encompasses the collector panel and an upper portion of said parabolic shaped lower wall structure; and wherein said hood means is spaced outwardly from said parabolic shaped wall structure such that air may be induced generally upwardly therebetween and over said collector panel before efficiently transferring heat from said heater to the passing air.

2. The heater of claim 1 further including main duct means communicatively connected with said hood means; and auxiliary fan means associated with said heater for inducing air upwardly adjacent said lower generally parabolic wall structure and interiorly of said hood means whereby said auxiliary fan means is operative to induce air to pass over said heater where heat is transferred thereto before the air is directed to said main duct.

3. The heater of claim 1 wherein said lower parabola shaped wall structure is elongated and includes end walls secured at opposite ends thereof so as to form a closed firebox comprised of said end walls, said lower parabola shaped wall structure, and said collector panel.

4. The heater of claim 3 further including means communicatively connected with said defined firebox for allowing outside air to be directed therein for the purpose of supporting combustion.

5. The heater of claim 4 further including a grate supported in spaced apart relationship relative to the bottom area of said parabolic lower wall structure for supporting fuel such as wood, coal, or the like thereabove, where the same is burned about the foci area of the heater.

6. The heater of claim 5 wherein said heater is used in conjunction with a structure to be heated, and wherein said main duct extending from said heater extends through said structure and is provided with a plurality of outlet means where heated air being transferred through said duct is dispersed into the structure.

7. The heater of claim 6 wherein said main duct means is housed within said structure about upper corner edges of walls forming a part of said structure.

* * * * *